US011248472B2

(12) United States Patent
Lee

(10) Patent No.: US 11,248,472 B2
(45) Date of Patent: Feb. 15, 2022

(54) TURBINE AIRFOIL WITH TRAILING EDGE COOLING FEATURING AXIAL PARTITION WALLS

(71) Applicant: Siemens Energy Global GmbH & Co. KG, Munich (DE)

(72) Inventor: Ching-Pang Lee, Cincinnati, OH (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 217 days.

(21) Appl. No.: 15/764,164

(22) PCT Filed: Oct. 30, 2015

(86) PCT No.: PCT/US2015/058177
§ 371 (c)(1),
(2) Date: Mar. 28, 2018

(87) PCT Pub. No.: WO2017/074403
PCT Pub. Date: May 4, 2017

(65) Prior Publication Data
US 2018/0266254 A1 Sep. 20, 2018

(51) Int. Cl.
*F01D 5/18* (2006.01)
*F01D 9/04* (2006.01)
*F01D 25/12* (2006.01)

(52) U.S. Cl.
CPC ..... *F01D 5/187* (2013.01); *F01D 5/186* (2013.01); *F01D 9/041* (2013.01); *F01D 25/12* (2013.01);
(Continued)

(58) Field of Classification Search
CPC ..... F01D 5/18; F01D 5/186; F01D 5/187
(Continued)

(56) References Cited

U.S. PATENT DOCUMENTS 6,602,047 B1 * 8/2003 Barreto ..... F01D 5/187 415/1
6,890,154 B2 * 5/2005 Cunha ..... F01D 5/187 415/115
(Continued)

FOREIGN PATENT DOCUMENTS

CN 104675445 A 6/2015
EP 1707741 A2 10/2006
(Continued)

OTHER PUBLICATIONS

PCT International Search Report and Written Opinion dated Jun. 28, 2016 corresponding to PCT Application No. PCT/US2015/058177 filed Oct. 30, 2015.

*Primary Examiner* — Justin D Seabe

(57) ABSTRACT

A trailing edge cooling feature for a turbine airfoil (10) includes a plurality of pins (22*a-l*) positioned in an airfoil interior (11) toward the trailing edge 20), each extending from the pressure side (14) to the suction side (16) and further being elongated in a radial direction (R). The pins (22*a-l*) are arranged in multiple radial rows (A-L) spaced along the chordal axis (30), with the pins (22*a-l*) in each row (A-L) being interspaced to define coolant passages (24*a-l*) therebetween. A row of radially spaced apart partition walls (26) are positioned aft of the pins (22*a-l*). Each partition wall (26) extends from the pressure side (14) to the suction side (16) and is elongated in a generally axial direction, extending along the chordal axis (30) to terminate at the trailing edge (20). Axially extending coolant exit slots (28) are defined in the interspaces between adjacent partition walls (26*a-b*) that direct coolant exiting a last row (L) of pins (221) to be discharged from the airfoil (10) into a hot gas path.

16 Claims, 4 Drawing Sheets

(52) U.S. Cl.
CPC .... *F05D 2220/32* (2013.01); *F05D 2240/126* (2013.01); *F05D 2260/201* (2013.01); *F05D 2260/2212* (2013.01)

(58) Field of Classification Search
USPC ..... 415/115; 416/97 R
See application file for complete search history.

(56) References Cited

U.S. PATENT DOCUMENTS

| | | | | |
|---|---|---|---|---|
| 7,575,414 | B2 * | 8/2009 | Lee | F01D 5/186 415/115 |
| 2014/0044555 | A1 | 2/2014 | Lewis et al. | |

FOREIGN PATENT DOCUMENTS

| | | | |
|---|---|---|---|
| EP | 2713012 | A1 | 4/2014 |
| WO | 9412767 | A1 | 6/1994 |

* cited by examiner

VIEW III-III

VIEW V-V

TURBINE AIRFOIL WITH TRAILING EDGE COOLING FEATURING AXIAL PARTITION WALLS

BACKGROUND

1. Field

This invention relates generally to an airfoil in a turbine engine, and in particular, to a trailing edge cooling feature incorporated in a turbine airfoil.

2. Description of the Related Art

In gas turbine engines, compressed air discharged from a compressor section and fuel introduced from a source of fuel are mixed together and burned in a combustion section, creating combustion products defining a high temperature working gas. The working gas is directed through a hot gas path in a turbine section of the engine, where the working gas expands to provide rotation of a turbine rotor. The turbine rotor may be linked to an axial shaft to power the upstream compressor and an electric generator, wherein the rotation of the turbine rotor can be used to produce electricity in the generator.

In view of high pressure ratios and high engine firing temperatures implemented in modern engines, certain components, such as airfoils, e.g., stationary vanes and rotating blades within the turbine section, must be cooled with cooling fluid, such as air discharged from a compressor in the compressor section, to prevent overheating of the components.

Effective cooling of turbine airfoils requires delivering the relatively cool air to critical regions such as along the trailing edge of a turbine blade or a stationary vane. The associated cooling apertures may, for example, extend between an upstream, relatively high pressure cavity within the airfoil and one of the exterior surfaces of the turbine blade. Blade cavities typically extend in a radial direction with respect to the rotor and stator of the machine.

Airfoils commonly include internal cooling channels which remove heat from the pressure sidewall and the suction sidewall in order to minimize thermal stresses. Achieving a high cooling efficiency based on the rate of heat transfer is a significant design consideration in order to minimize the volume of coolant air diverted from the compressor for cooling. However, the relatively narrow trailing edge portion of a gas turbine airfoil may include, for example, up to about one third of the total airfoil external surface area. The trailing edge is made relatively thin for aerodynamic efficiency. Consequently, with the trailing edge receiving heat input on two opposing wall surfaces which are relatively close to each other, a relatively high coolant flow rate is entailed to provide the requisite rate of heat transfer for maintaining mechanical integrity.

SUMMARY

Briefly, aspects of the present invention provide an improved trailing edge cooling feature for a turbine airfoil.

An airfoil may comprise an outer wall formed by a pressure side and a suction side joined at a leading edge and at a trailing edge. The outer wall may extend span-wise along a radial direction of the turbine engine and may delimit an airfoil interior. A chordal axis may be defined as extending centrally between the pressure and suction sides.

According to a first aspect of the invention, a plurality of pins may be positioned in the airfoil interior toward the trailing edge. Each fin may extend from the pressure side to the suction side and may be elongated in a radial direction. The plurality of pins may be arranged in multiple radial rows spaced along the chordal axis, with the pins in each row being interspaced to define coolant passages therebetween. A row of radially spaced apart partition walls may be positioned aft of a last row of pins. Each partition wall may extend from the pressure side to the suction side. Each partition wall may be elongated in a generally axial direction, extending along the chordal axis to terminate at the trailing edge. Axially extending coolant exit slots may be defined in the interspaces between adjacent partition walls that direct coolant exiting the last row of pins to be discharged from the airfoil into a hot gas path.

According to a second aspect of the invention, a plurality of pins may be positioned in the airfoil interior toward the trailing edge. Each pin may extend from the pressure side to the suction side and may be elongated in a radial direction. The plurality of pins may be arranged in multiple radial rows spaced along the chordal axis, with the pins in each row being interspaced to define coolant passages therebetween and the pins in adjacent rows being staggered along the radial direction. A row of radially spaced apart partition walls may be positioned aft of a last row of pins. Each partition wall may extend from the pressure side to the suction side. Each partition wall may be elongated in a generally axial direction, extending along the chordal axis to terminate at the trailing edge. Axially extending coolant exit slots may be defined in the interspaces between adjacent partition walls that direct coolant exiting the last row of pins to be discharged from the airfoil into a hot gas path. A plurality of turbulators may be positioned in each exit slot. The turbulators may be angled to guide coolant flow in the exit slot toward the adjacent partition walls.

BRIEF DESCRIPTION OF THE DRAWINGS

The invention is shown in more detail by help of figures. The figures show preferred configurations and do not limit the scope of the invention.

DETAILED DESCRIPTION

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Figure 1:
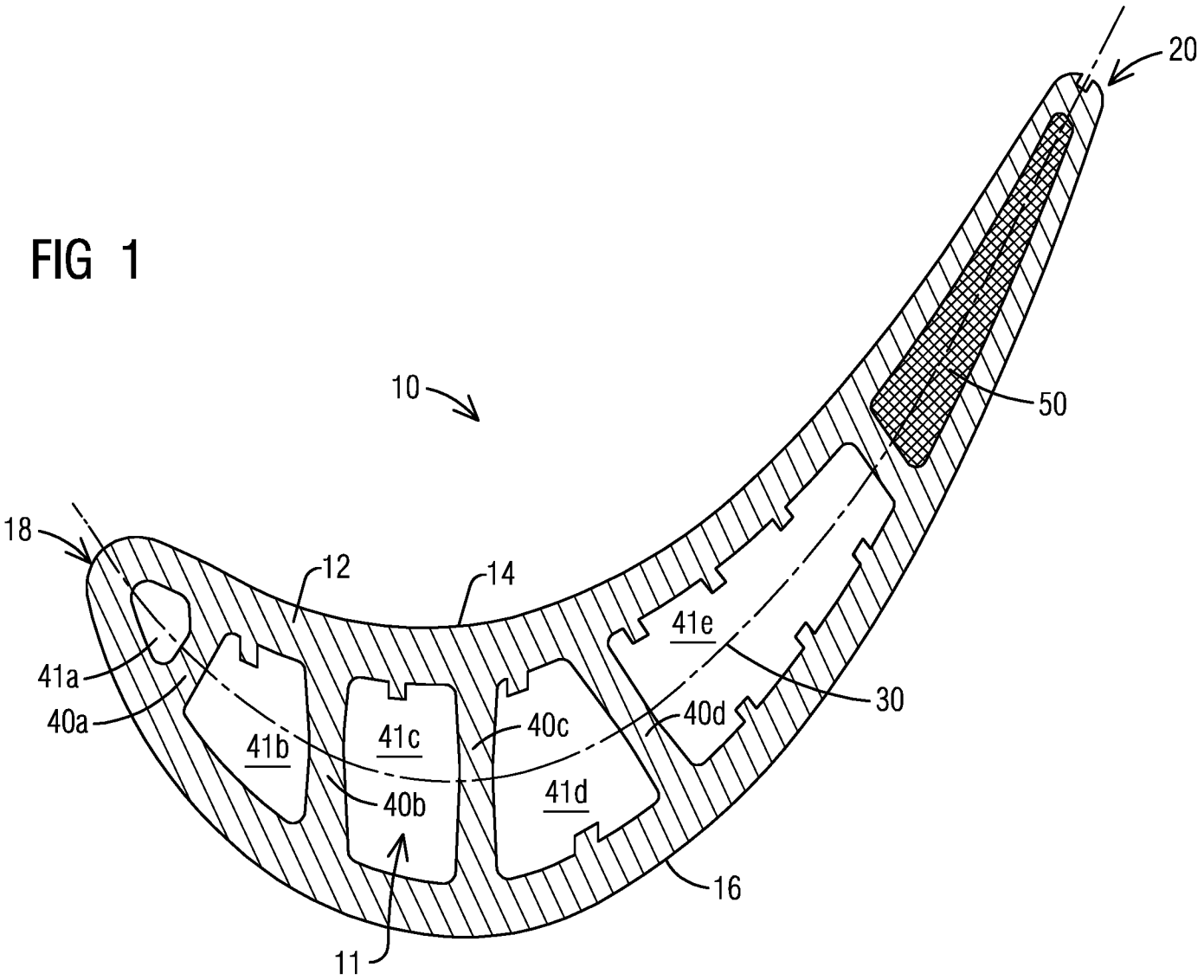
FIG. 1 is a cross-sectional view of a turbine airfoil including a trailing edge cooling feature.

Referring to FIG. 1, a turbine airfoil 10 may comprise an outer wall 12 delimiting a generally hollow airfoil interior 11. The outer wall 12 extends span-wise in a radial direction of the turbine engine, which is perpendicular to the plane of FIG. 1. The outer wall 12 is formed by a generally concave pressure side 14 and a generally convex suction side 16, joined at a leading edge 18 and at a trailing edge 20. A chordal axis 30 may be defined as extending centrally between the pressure side 14 and the suction side 16. In this description, the relative term "forward" refers to a direction along the chordal axis 30 toward the leading edge 18, while the relative term "aft" refers to a direction along the chordal axis 30 toward the trailing edge 20. As shown, internal passages and cooling circuits are formed by radial cavities 41*a-e* that are created by internal partition walls or ribs 40*a-d* which connect the pressure and suction sides 14 and 16.

As illustrated, the airfoil 10 is a turbine blade for a gas turbine engine. It should however be noted that aspects of the invention could additionally be incorporated into stationary vanes in a gas turbine engine. In the present example, coolant may enter one or more of the radial cavities 41*a-e* via openings provided in the root of the blade 10. For example, coolant may enter the radial cavity 41*e* via an opening in the root and travel radially outward to feed into forward and aft cooling branches. In the forward cooling branch, the coolant may traverse a serpentine cooling circuit toward a mid-chord portion of the airfoil 10 (not illustrated in any further detail). In the aft cooling branch, the coolant may traverse axially through an internal arrangement of a trailing edge cooling feature, schematically designated by the shaded region 50, positioned aft of the radial cavity 41*e*, before leaving the airfoil 10 via exhaust openings arranged along the trailing edge 20.

Conventional trailing edge cooling features included a series of impingement plates, typically two or three in number, arranged next to each other along the chordal axis 30. However, this arrangement provides that the coolant travels only a short distance before exiting the airfoil at the trailing edge 20. It may be desirable to have a longer coolant flow path along the trailing edge portion to have more surface area for transfer of heat, to improve cooling efficiency and reduce coolant flow requirement.

Figure 2:
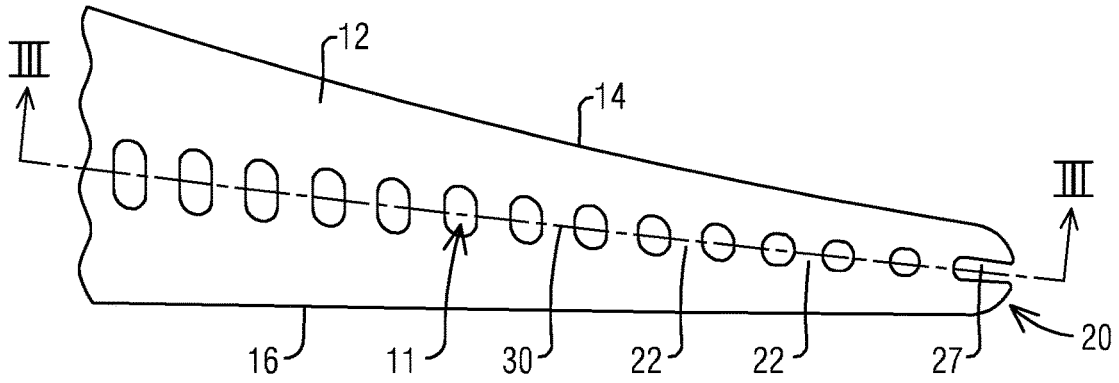
FIG. 2 is a cross-sectional view of a trailing edge portion of an airfoil comprising an array of elongated pins.
Figure 3:
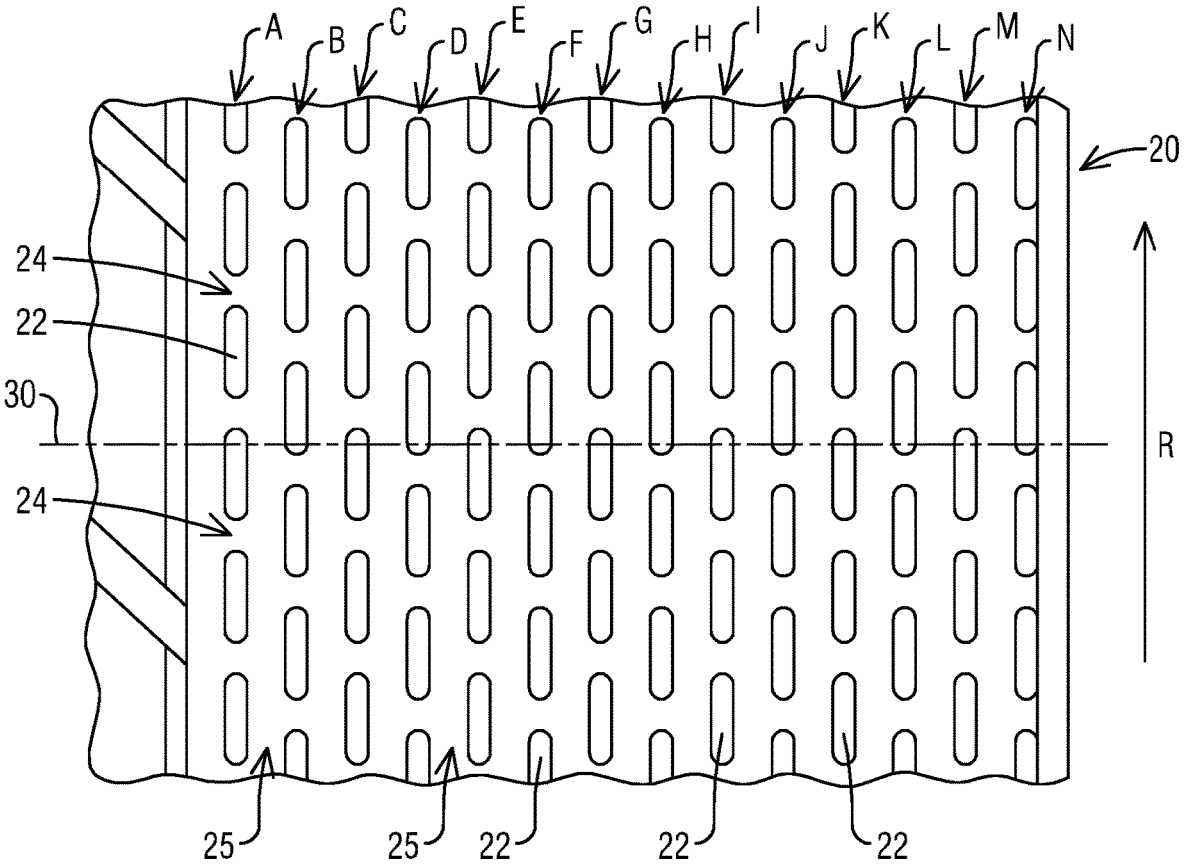
FIG. 3 is a sectional view along the section of FIG. 2.

FIGS. 2-3 illustrate an alternate arrangement of a trailing edge cooling feature. In this case, the impingement plates are replaced by an array of pins 22. Each pin 22 has an elongated shape, being elongated along the radial direction, and extends across the chordal axis 30 from the pressure side 14 to the suction side 16 as shown in FIG. 2. The pins 22 are arranged in radial rows indicated as A-N in FIG. 3. The pins 22 in each row are interspaced to define axial coolant passages 24. The rows A-N, in this case fourteen in number, are spaced along the chordal axis 30 to define radial coolant passages 25. As shown in FIG. 3, pins 22 in adjacent rows may be staggered in the radial direction R. The coolant exiting the last, i.e., aft-most row N of pins 22 is discharged via a row of exhaust orifices 27 positioned at the trailing edge 20 (see FIG. 2). In relation to the double or triple impingement plates, the described arrangement provides a longer flow path for the coolant and has been shown to increase both heat transfer and pressure drop to restrict the coolant flow rate. Such an arrangement may thus be suitable in advanced turbine blade applications which require smaller amounts of cooling air.

Nevertheless, it has been recognized by the present inventor(s) that in some applications, the above-mentioned arrangement may lead to recirculation or ingestion of hot gas into the trailing edge 20 immediately downstream of the last or aft-most row N of elongated pins 22 and upstream of the exhaust orifices 27. This may be caused by wakes downstream of the last row N of pins 22 which may create zones with pressures equal to or lesser than the pressure of the hot gas outside the airfoil 10. As a consequence of the ingestion of high temperature fluid, there may be an increase of heat flux at the trailing edge whereby heat from the hot fluid is transferred to the airfoil outer wall.

It is desirable to have an improved design that can prevent hot gas recirculation into the airfoil trailing edge 20. One way to address the issue may include extending the rows of pins 22 all the way up to the trailing edge 20. However, many turbine airfoils are currently manufactured by casting, and this technique may provide reduced tolerance during machining of the trailing edge subsequent to casting. This is particularly true for machining of very sharp trailing edges. Another possible way to address the problem of hot gas recirculation or ingestion may be to increase the thickness of the pins 22 in the axial direction, i.e., along the chordal axis 30, which, in turn, may lead to less effective cooling.

Figure 4:
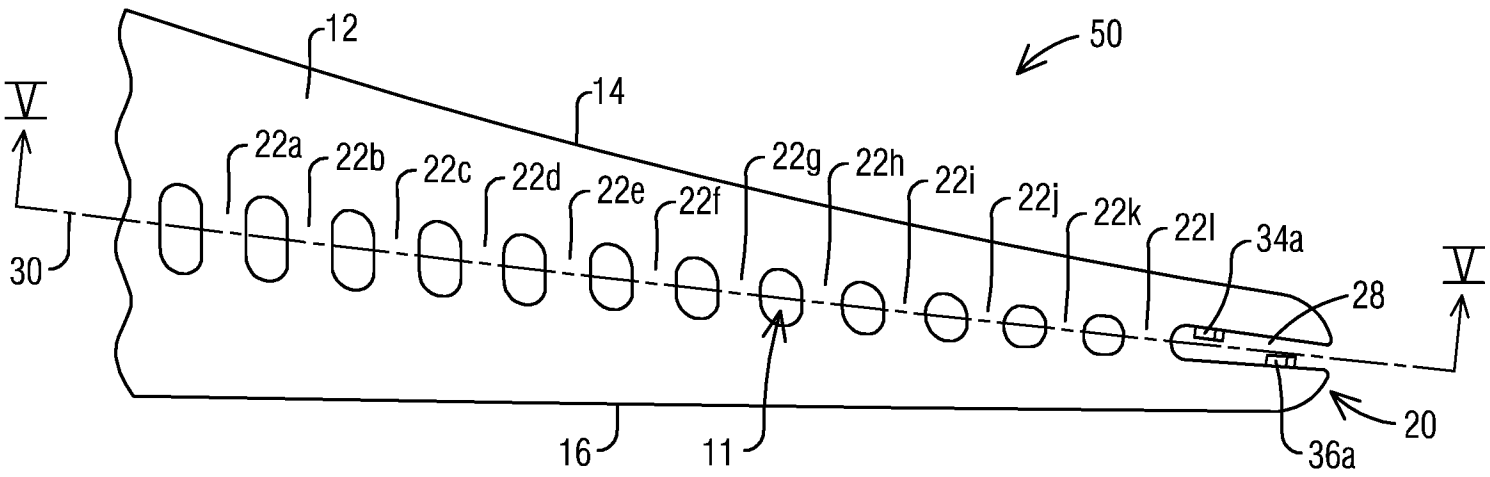
FIG. 4 is a cross-sectional view of a trailing edge portion of an airfoil comprising a trailing edge cooling feature according to one embodiment of the present invention.
Figure 5:
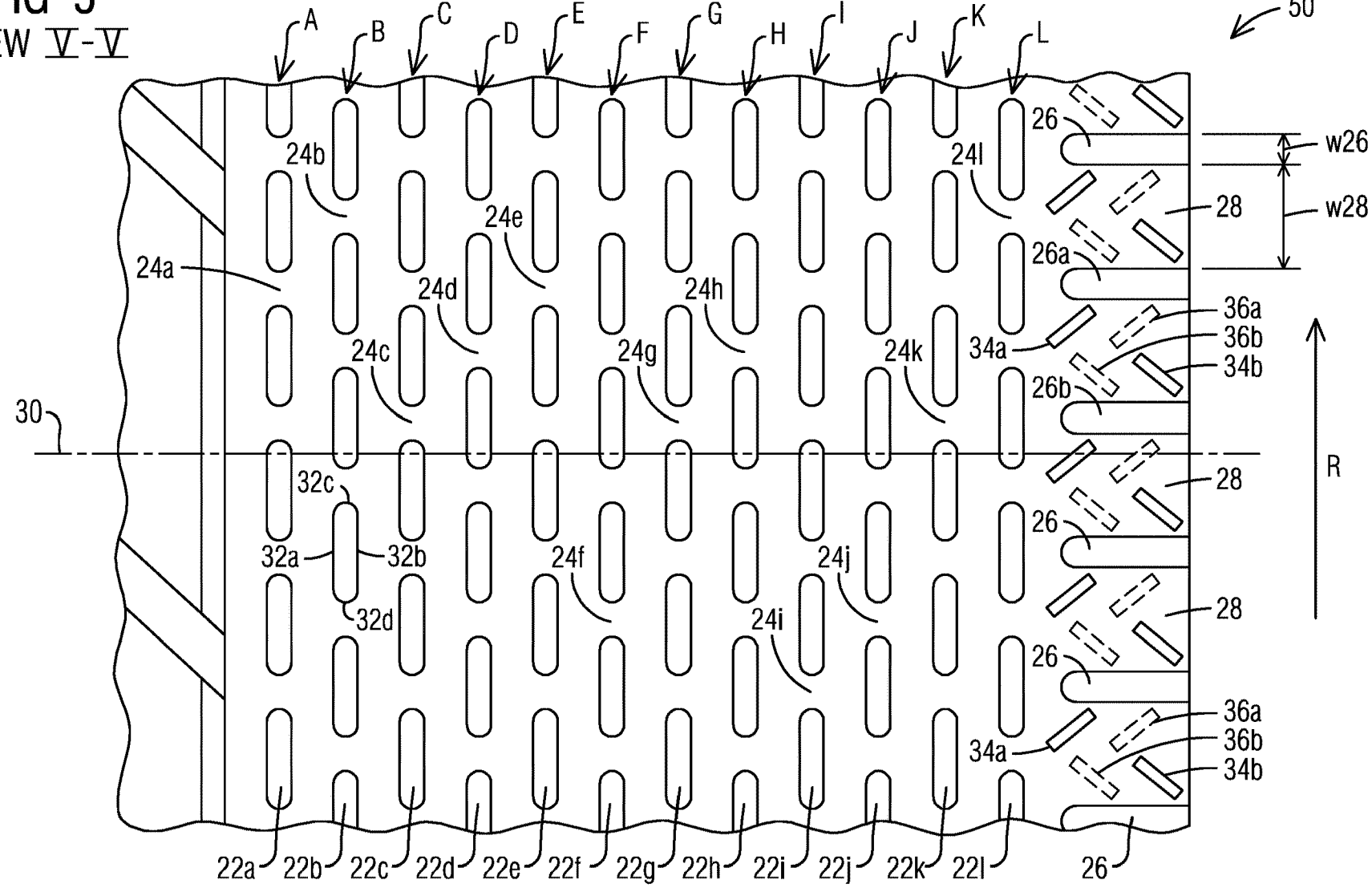
FIG. 5 is a sectional view along the section V-V of FIG. 4

FIGS. 4-5 illustrate a trailing edge cooling feature 50 in accordance with embodiments of the present invention. The embodiments are based on the inventive recognition that the mechanism of the hot gas recirculation or ingestion into the trailing edge is the high coolant blockage caused by the last or aft-most row of elongated pins. As shown, a plurality of elongated pins 22*a*-1 are positioned in the airfoil interior 11 toward the trailing edge 20. Each elongated pin 22*a*-1 extends from the pressure side 14 to the suction side 16 (see FIG. 4) and is further elongated in the radial direction R (see FIG. 5). Referring in particular to FIG. 5, the plurality of pins 22*a*-1 are arranged in multiple (in this case, twelve) radial rows A-L placed in series and spaced along the chordal axis 30. The pins 22*a*-1 in each row are interspaced to define axial coolant passages 24*a*-1 therebetween. A row of radially spaced apart axial partition walls 26 are positioned aft of a last row L pins 221. Each axial partition wall 26 extends from the pressure side 14 to the suction side 16 and is elongated in a generally axial direction. That is, the axial partition walls 26 extend along the chordal axis 30, terminating at the trailing edge 20. Axially extending coolant exit slots 28 are defined in the interspaces between adjacent partition walls 26 that direct coolant exiting the last row L of pins 221 to be discharged from the airfoil 10 into a hot gas path. Each exit slot 28 may be considered to be defined by two adjacent partition walls 26, namely a radially outer adjacent partition wall 26*a* and a radially inner adjacent partition wall 26*b*.

As can be discerned, in relation to the implementation shown in FIG. 3, in the present embodiment, the aft-most rows (in this case the last two rows M and N) of elongated pins are eliminated and replaced by the axial partition walls 26. The axial partition walls 26 have been shown to eliminate the above-mentioned wake blockage effects that may cause a low pressure zone downstream of the last row L of pins 221 to potentially result in hot gas recirculation or ingestion. Moreover, the axial partition walls 26 provide structural support between the pressure side 14 and the suction side 16 and allow for more machining tolerance post casting.

In the illustrated embodiment, each elongated pin 22*a*-1 has a length dimension parallel to the radial direction R that is greater than a width dimension parallel to the chordal axis 30. As shown in FIG. 5, each elongated pin 22*a*-1 may be made up of first and second sides 32*a-b* generally parallel to the radial direction R, and third and fourth sides 32*c-d* extending transverse to the radial direction R. In this case, the third and fourth sides 32*c-d* are convex. The above configuration has been shown to provide both high heat transfer rates as well as high pressure drop, thereby restricting coolant flow rates. In other embodiments, the elongated pins 22*a*-1 may have alternate cross-sectional shapes, such as rectangular, elliptical, oval, among others.

As shown in FIG. 5, to ensure that wake blockage effects are minimized, the width w28 of each exit slot 28 may be substantially greater than a width w26 of each axial partition wall 26 along the radial direction R. As an example, the ratio of the width w28 to the width w26 may be equal to or greater than 3. The numerical frequency of axial partition walls 26 in the radial direction R may preferably be equal to that of the pins 221 in the radial direction R. Furthermore, the axial partition walls 26 may have a length dimension along the chordal axis 30 that is substantially greater than a width dimension in the radial direction R. A smaller thickness in the radial direction R also ensures reduced coolant blockages and enhances direct cooling in the exit slots 28. In the shown embodiment, the axial partition walls 26 occupy radial positions that are staggered with respect to coolant passages 241 in the last row L of pins 221. In particular, each of the axial partition walls 26 may occupy a radial position that is aligned with a mid portion of a respective pin 221 in the last row L. In this case, each exit slot 20 may extend between adjacent axial partition walls 26*a* and 26*b* that are aligned with the mid portions of adjacent pins 221 in the last row L.

In a further embodiment, one or more turbulators 34*a-b*, 36*a-b* may be positioned in each exit slot 28 at the pressure side 14 and the suction side 16. In the shown example, the turbulators 34*a-b* are positioned at the pressure side 14 while the turbulators 36*a-b* are positioned at the suction side 16. The turbulators 34*a-b*, 36*a-b* provide increased turbulence while reducing flow area of the coolant in the exit slots 28, to enhance convective heat transfer. As shown in FIG. 5, the turbulators at the pressure and suction sides may be offset along the chordal axis 30 and may overlap in a direction transverse to the chordal axis 30. Additionally, the turbulators 34*a*/36*a* and 34*b*/36*b* may be angled to point radially outward or inward respectively. The angled turbulators 34*a-b*, 36*a-b* push the coolant flow toward the adjacent partition walls 26*a* and 26*b* to ensure an effective coolant spread in the radial direction, thereby providing more uniform heat transfer along the trailing edge 20. The divergent flow caused by the turbulators 34*a-b*, 36*a-b* may further reduce hot gas recirculation or ingestion at the trailing edge 20. In particular, each of the pressure side 14 and the suction side 16 may have at least one turbulator 34*a*, 36*a* angled toward a radially outer adjacent partition wall 26*a* and at least one turbulator 34*b*, 36*b* angled toward a radially inner adjacent partition wall 26*b*. In this case, turbulators 34*a*, 36*a* angled toward the radially outer adjacent partition wall 26*a* may alternate with turbulators 34*b*, 36*b* angled toward the radially inner adjacent partition wall 26*b* along the chordal axis 30, as shown in FIG. 5.

In one embodiment, the axial partition walls 26 and the turbulators 34*a-b*, 36*a-b* may be manufactured by casting. The illustrated embodiments may provide more manufacturing tolerance during subsequent machining of the trailing edge than in the case where the elongated fins are adjacent to the exit.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. An airfoil for a turbine engine comprising:

an outer wall delimiting an airfoil interior, the outer wall extending span-wise in a radial direction of the turbine engine and being formed by a pressure side and a suction side joined at a leading edge and at a trailing edge, wherein a chordal axis is defined extending centrally between the pressure and suction sides;

a plurality of pins positioned in the airfoil interior toward the trailing edge, each extending from the pressure side to the suction side and further being elongated in a radial direction, the plurality of pins being arranged in multiple radial rows spaced along the chordal axis, with the pins in each row being interspaced to define coolant passages therebetween; and a row of radially spaced apart partition walls positioned aft of a last row of pins, wherein each partition wall extends from the pressure side to the suction side and is elongated in a generally axial direction, extending along the chordal axis to terminate at the trailing edge, whereby axially extending coolant exit slots are defined in the interspaces between adjacent partition walls that direct coolant exiting the last row of pins to be discharged from the airfoil into a hot gas path, wherein each elongated pin of the plurality of pins has a length dimension parallel to the radial direction that is greater than a width dimension parallel to the chordal axis, wherein each of the partition walls occupies a radial position that is aligned with a mid portion of a respective pin in the last row of pins, and wherein one or more turbulators are positioned in each exit slot at the pressure side and the suction side respectively.

2. The airfoil according to claim 1, wherein the pins in adjacent rows are staggered in the radial direction.

3. The airfoil according to claim 1, wherein each elongated pin of the plurality of pins is made up of first and second sides generally parallel to the radial direction, and third and fourth sides extending transverse to the radial direction.

4. The airfoil according to claim 3, wherein the third and fourth sides are convex.

5. The airfoil according to claim 1, wherein along the radial direction, a width of each exit slot is greater than a width of each partition wall.

6. The airfoil according to claim 1, wherein the partition walls occupy radial positions that are staggered with respect to coolant passages in the last row of pins.

7. The airfoil according to claim 1, wherein the turbulators at the pressure side and suction side are offset along the chordal axis.

8. The airfoil according to claim 1, wherein the turbulators at the pressure side and suction side overlap in a direction transverse to the chordal axis.

9. The airfoil according to claim 1, wherein the turbulators are angled to guide coolant flow in the exit slot toward the adjacent partition walls.

10. The airfoil according to claim 9, wherein each of the pressure side and the suction side has at least one turbulator angled toward a radially outer adjacent partition wall and at least one turbulator angled toward a radially inner adjacent partition wall.

11. The airfoil according to claim 10, wherein turbulators angled toward the radially outer adjacent partition wall alternate with turbulators angled toward the radially inner adjacent partition wall along the chordal axis.

12. An airfoil for a turbine engine comprising:

an outer wall delimiting an airfoil interior, the outer wall extending span-wise in a radial direction of the turbine engine and being formed by a pressure side and a suction side joined at a leading edge and at a trailing edge, wherein a chordal axis is defined extending centrally between the pressure and suction sides;

a plurality of pins positioned in the airfoil interior toward the trailing edge, each extending from the pressure side to the suction side and further being elongated in a radial direction, the plurality of pins being arranged in multiple radial rows spaced along the chordal axis, with the pins in each row being interspaced to define coolant passages therebetween and the pins in adjacent rows being staggered along the radial direction;

a row of radially spaced apart partition walls positioned aft of a last row of pins, wherein each partition wall extends from the pressure side to the suction side and is elongated in a generally axial direction, extending along the chordal axis to terminate at the trailing edge, whereby axially extending coolant exit slots are defined in the interspaces between adjacent partition walls that direct coolant exiting the last row of pins to be discharged from the airfoil into a hot gas path; and a plurality of turbulators positioned in each exit slot, the turbulators being angled to guide coolant flow in the exit slot toward the adjacent partition walls, wherein each elongated pin of the plurality of pins has a length dimension parallel to the radial direction that is greater than a width dimension parallel to the chordal axis, and wherein each of the partition walls occupies a radial position that is aligned with a mid portion of a respective pin in the last row of pins.

13. The airfoil according to claim 12, wherein along the radial direction, a width of each exit slot is greater than a width of each partition wall.

14. The airfoil according to claim 12, wherein the partition walls occupy radial positions that are staggered with respect to coolant passages in the last row of pins.

15. The airfoil according to claim 12, wherein each of the pressure side and the suction side has at least one turbulator angled toward a radially outer adjacent partition wall and at least one turbulator angled toward a radially inner adjacent partition wall.

16. The airfoil according to claim 15, wherein turbulators angled toward the radially outer adjacent partition wall alternate with turbulators angled toward the radially inner adjacent partition wall along the chordal axis.

* * * * *